US006568795B1

(12) United States Patent
Sharma et al.

(10) Patent No.: US 6,568,795 B1
(45) Date of Patent: May 27, 2003

(54) DROP-ON-DEMAND INK JET PRINTING WITH CONTROLLED FLUID FLOW DURING DROP EJECTION

(75) Inventors: Ravi Sharma, Fairport, NY (US); Zhihao Yang, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/075,331

(22) Filed: Feb. 14, 2002

(51) Int. Cl.[7] ..... B41J 2/05; B41J 2/17
(52) U.S. Cl. ..... 347/65; 347/94
(58) Field of Search ..... 347/65, 94; 137/13, 137/341, 807, 828; 251/11

(56) References Cited

U.S. PATENT DOCUMENTS

| | | | |
|---|---|---|---|
| 5,026,427 A | | 6/1991 | Mitchell et al. |
| 5,085,698 A | | 2/1992 | Ma et al. |
| 5,141,556 A | | 8/1992 | Matrick |
| 5,160,370 A | | 11/1992 | Suga et al. |
| 5,169,436 A | | 12/1992 | Matrick |
| 5,482,545 A | | 1/1996 | Aoki et al. |
| 6,102,530 A | * | 8/2000 | Kim et al. |

FOREIGN PATENT DOCUMENTS

| | | |
|---|---|---|
| EP | 0 802 246 A1 | 10/1997 |
| JP | 9-202043 | 8/1997 |

* cited by examiner

*Primary Examiner*—John Barlow
*Assistant Examiner*—Michael S Brooke
(74) *Attorney, Agent, or Firm*—Milton S. Sales

(57) ABSTRACT

A drop-on-demand ink jet printing system includes an ink channel having a nozzle orifice through which ink droplets are ejected when ink in the ink channel is subjected to a momentary positive pressure wave. An ink feed passage opens into the ink channel to transport ink into the channel from an ink reservoir. A selectively-actuated valve, associated with the ink feed passage, restricts the flow of ink through the ink feed passage when actuated. The valve is actuated in timed association with the momentary pressure wave, whereby flow of ink past the valve from the ink channel towards the reservoir is inhibited. The ink feed passage may be a microfluidic channel, and the selectively-actuated valve a heater in thermal contact with at least a portion of the associated microfluidic channel, whereby thermally-responsive ink in the ink feed passage can selectively be heated by the heater such that the thermally-responsive ink will be caused to increase in viscosity to thereby restrict backward ink flow through the ink feed passage. The ink may be comprised of a carrier having a tri-block copolymer of poly(ethylene oxide)-poly(propylene oxide)-poly(ethylene oxide).

9 Claims, 3 Drawing Sheets

DROP-ON-DEMAND INK JET PRINTING WITH CONTROLLED FLUID FLOW DURING DROP EJECTION

CROSS REFERENCE TO RELATED APPLICATIONS

Reference is made to commonly assigned co-pending U.S. patent application Ser. No. 09/735,322 filed in the names of Yang et al. on Dec. 12, 2000.

FIELD OF THE INVENTION

This invention generally relates to a drop-on-demand ink jet printer in which the flow of ink toward the ink reservoir during droplet ejection is controlled.

BACKGROUND OF THE INVENTION

Drop-on-demand ink jet printers selectively eject droplets of ink toward a receiver to create an image. Such printers typically include a print head having an array of nozzles, each of which is supplied with ink from a reservoir. Each of the nozzles communicates with a chamber that can be pressurized in response to an electrical impulse to induce the generation of an ink droplet from the outlet of the nozzle. Some such printers, commercial and theoretically-known, use piezoelectric transducers to create the momentary forces necessary to generate an ink droplet. A squeezing action by the piezoelectric transducers causes ink to flow out of the nozzles, but also causes some ink to flow backward toward the ink reservoir. Considerable energy is wasted, as not all of the pressure generated by the piezoelectric transducers results in droplet formation. Thus, a higher voltage must be applied to compensate for the loss.

The amount of backward flow of ink may be reducible by providing a narrow entry channel into the ink chamber from the reservoir. However, this would result in an undesirable increase in chamber refill time.

SUMMARY OF THE INVENTION

According to the present invention, the amount of backward flow of ink is reduced, while allowing free forward flow into the ink chamber by providing a valve in the entry channel to the ink chamber. During droplet ejection, the valve chokes back flow to improve efficiency. During chamber refill, the valve is opened, reducing refill time.

While any valve would be useful, response time of the valve should be better than the refill time for the chamber. According to a preferred embodiment of the present invention, a thermally activated valve, in which heat causes a thermal-reversible gel to form in the fluid channel, is provided to impede ink flow. When the heat is reduced, the gel returns to a freely-flowing fluid. By timing the heat pulse and the piezo device, drop ejection efficiency and refill time can be optimized.

According to one feature of the present invention, a drop-on-demand ink jet printing system includes a channel having a nozzle orifice through which ink droplets are ejected when ink in the channel is subjected to a momentary positive pressure wave. An ink feed passage opens into the ink channel to transport ink into the channel from an ink reservoir. A selectively-actuated valve, associated with the ink feed passage, restricts the flow of ink through the ink feed passage when actuated. The valve is actuated in timed association with the momentary pressure wave, whereby flow of ink past the valve from the ink channel towards the reservoir is inhibited.

According to another feature of the present invention, the ink feed passage is a microfluidic channel, and the selectively-actuated valve comprises a heater in thermal contact with at least a portion of the associated microfluidic channel. Thermally-responsive ink in the ink feed passage can selectively be heated by the heater such that the thermally-responsive ink will be caused to increase in viscosity to thereby restrict ink flow through the ink feed passage.

BRIEF DESCRIPTION OF THE DRAWINGS

While the specification concludes with the claims particularly pointing out and distinctly claiming the subject matter of the present invention, it is believed that the invention will be better understood from the following detailed description when taken in conjunction with the following drawings wherein:

DETAILED DESCRIPTION OF THE INVENTION

The present description will be directed in particular to elements forming part of, or cooperating more directly with, an apparatus and method and in accordance with the present invention. It is to be understood that elements not specifically shown or described may take various forms well known to those skilled in the art.

Figure 1:
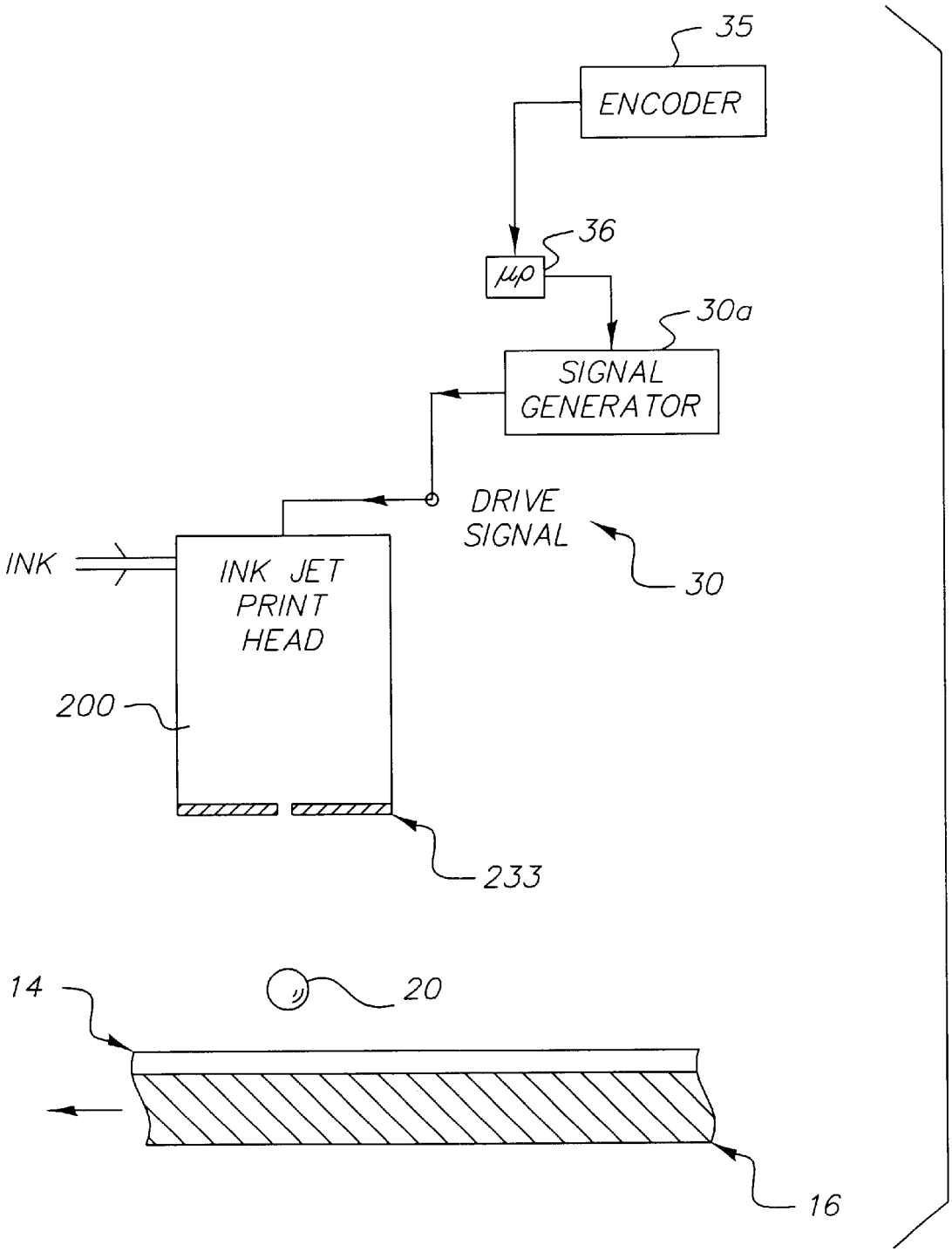
FIG. 1 is a simplified schematic view of an ink jet print head, showing ejection of a liquid droplet onto a receiver.

Referring to FIG. 1, an inkjet print head 200 is shown, ejecting a liquid droplet 20 through a nozzle plate 233, onto a surface 14 of a moving receiver 16. Print head 200 is supplied with ink to be ejected, and is activated by an electrical drive signal 30 produced by a signal generator. The ink jet print head may contain a piezoelectric actuator, whose electrodes are connected to receive drive signal 30. The electrode polarities are chosen such that the downward-going voltage edge 301, see FIG. 2, causes an outward mechanical expansion of an actuator, drawing ink 22 into print head 200. The upward-going voltage edges 302 and 303 cause inward compression of the actuator, expelling liquid from the nozzles. Finally, the downward-going voltage edge 304 returns the actuator to its original state, in readiness for the next actuation.

Figure 3A:
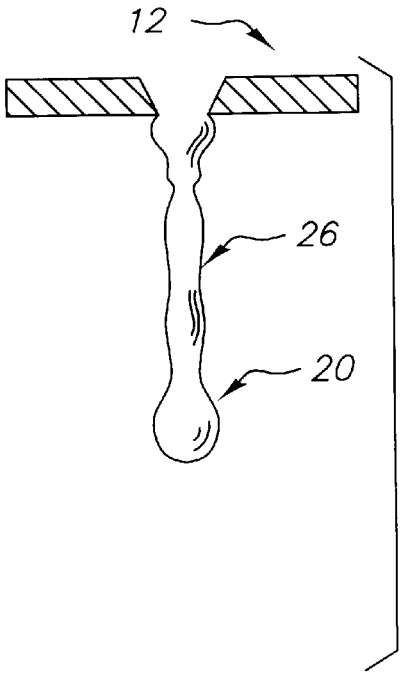
FIG. 3*a* is a photomicrograph of liquid structure being ejected, at a time just before the liquid structure detaching from the nozzle plate, as a result of applying the electrical drive waveform in FIG. 2.
Figure 3B:
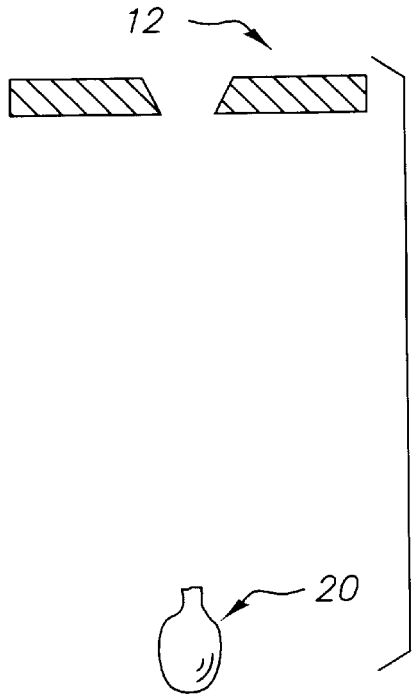
FIG. 3*b* is a photomicrograph of the liquid structures that are ejected, at a time 30 microseconds after the time shown in FIG. 3*a;*

FIG. 3*a* is a photomicrograph of a liquid structure ejected from nozzle plate 233 upon application electrical drive signal 30 to print head 200. The liquid structure takes the form of a ligament 26. The photomicrograph is taken at a time close to, but just before, detachment of the liquid structure from nozzle plate 233. FIG. 3*b* is a photomicrograph, taken thirty microseconds after the time of FIG. 3*a*, of the liquid structure. The ligament 26 has broken off one small drop, which then quickly combines with the main droplet 20, as the shown in FIG. 3*b*.

Figure 4:
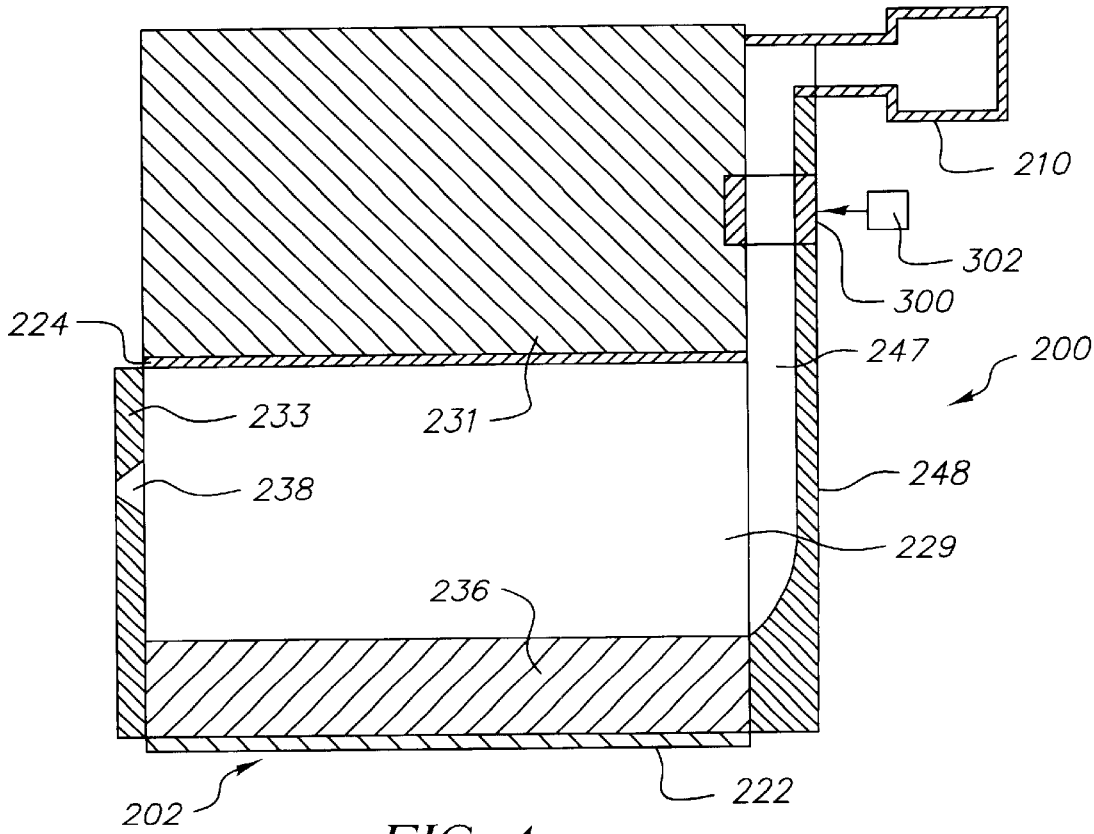
FIG. 4 is a cross-sectional side view of an inkjet print head of FIG. 1 showing in greater detail a single channel of the ink jet print head.

FIG. 4 is a cross-sectional side view of a single channel of ink jet print head 200. Print head structure 200 comprises a transducer 202, formed of piezoelectric material, into which is cut an ink channel 229 bordered along one end by nozzle plate 233 having a nozzle orifice 238 there through. A rear cover plate 248 is suitably secured to the other end of ink channel 229. A cover 231 and a base portion 236 complete the enclosure of the ink channel, which is supplied with ink from an ink reservoir 210 through ink feed passage 247 in rear cover plate 248. Actuation of transducer 202 results in the expulsion of ink droplets from ink channel 229 through nozzle orifice 238.

Figure 5:
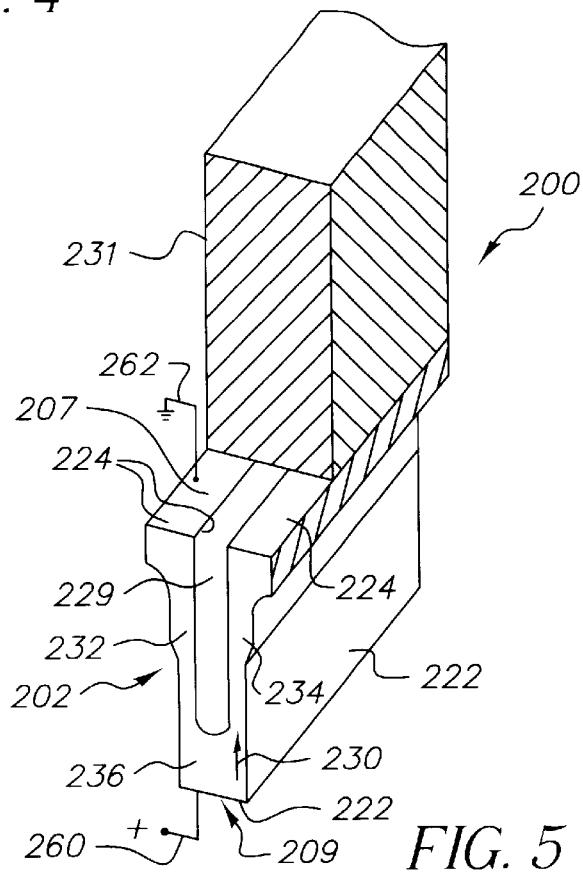
FIG. 5 is a partial perspective view of the ink jet print head structure of FIG. 4.

FIG. 5 shows the print head transducer of FIG. 4 in greater detail. The print head transducer comprises a first wall portion 232, a second wall portion 234, and a base portion 236. The upper surfaces of first and second wall portions 232 and 234 define a first face 207 of transducer 202, and the lower surface of base portion 236 defines a second opposite face 209 of transducer 202. Ink channel 229 is defined on three sides by the inner surface of base portion 236 and the inner wall surfaces of wall portions 232 and 234, and is an elongated channel cut into the piezoelectric material of transducer 202. This leaves a lengthwise opening along the upper first face of transducer 202. One end of ink channel 229 is closed by nozzle plate 233, while the other end is closed by rear cover plate 248. A metallization layer 224 coats the inner surfaces of ink channel 229 and is also deposited along the upper surfaces of first wall portion 232 and second wall portion 234. Cover 231 is bonded over the first face of transducer 202 to close the lengthwise lateral opening in ink channel 229. A second metallization layer 222 coats the outer surfaces of base portion 236, and also extends approximately half way up each of the outer surfaces of first and second wall portions 232 and 234.

Metallization layer 222 defines an addressable electrode 260, which is connected to signal generator 30*a* (FIG. 1) to provide electrical drive signals to actuate the piezoelectric material of transducer 202. Metallization layer 224 defines a common electrode 262 that is maintained at ground potential.

The print head of FIGS. 4 and 5 works upon the principle of the piezoelectric effect, where the application of an electrical signal across certain faces of piezoelectric material produces a corresponding mechanical distortion or strain in that material. In general, an applied voltage of one polarity will cause material to bend in the first direction, and an applied voltage of the opposite polarity will cause material to bend in the second direction opposite that of the first. Application of a positive voltage to electrodes 260 results in movement of the base portion 236 and wall portions 232 and 234 inward, toward channel 229, resulting in a diminishment of the interior volume of ink channel 229. Upon application of negative voltage to addressable electrode 260 there is a resulting net volume increase in the interior volume of ink channel 229. This change in volume within channel 229 generates an acoustic pressure wave within ink channel 229, and this pressure wave within channel 229 provides energy to expel ink from orifice 238 of print head structure 220 onto receiver 16. Typically, signals from an external encoder 35 are provided to a microprocessor 36 which outputs control signals to the signal generator linked to the motion of the print head so that the expelled ink droplets are ejected with optimal timing to impact the receiver at the correct position.

One or more heaters 300 are positioned on the inner surfaces of ink feed passage 247 in rear cover plate 248 such that a microfluidic valve is formed in the ink feed passage 247. A single heater could extend substantially around the ink feed passage. The terms "microfluidic", "microscale" and "microfabricated" generally refer to structural elements or features of a device, such as ink feed passage 247, having at least one fabricated dimension in the range from about 0.1 $\mu$m to about 500 $\mu$m. In devices according to the present invention, microscale ink feed passage 247 preferably has at least one internal cross-section dimension, e.g., depth, width, length, diameter, etc., between about 0.1 $\mu$m to about 500 $\mu$m, preferably between about 1 $\mu$m to about 200 $\mu$m.

Heaters 300, preferably made from appropriately doped polysilicon, are fabricated on the inner surfaces of ink feed passage 247. A conducting material, not shown, such as aluminum or copper, is also integrated to serve as wires to connect the heaters to an external power supply. In a preferred embodiment of the invention, the microfluidic devices are fabricated using CMOS compatible fabrication techniques, and the heaters are integrated with a CMOS circuit controller 302 on the chip. The controller is adapted to actuate the valve by signals or voltages applied to the heaters.

Various techniques using chip technology for the fabrication of microfluidic devices, and particularly micro-capillary devices, with silicon and glass substrates have been discussed by Manz, et al. (*Trends in Anal. Chem.* 1990, 10, 144, and *Adv. In Chromatog.* 1993, 33, 1). Other techniques such as laser ablation, air abrasion, injection molding, embossing, etc., are also known to be used to fabricate microfluidic devices, assuming compatibility with the selected substrate materials.

The function of a microfluidic valve is to control the flow rate or volume flux of a liquid through a micro-capillary channel. In general, for a fluid with a viscosity of $\mu$ that is driven through a micro-capillary channel with a length of L by a pressure of P, the volume flux, Q, of the liquid pass through the channel is:

$$Q = \frac{P}{\mu L} \cdot f,$$

where $f$ is the dimension factor of the cross-section for the microfluidic channel.

For a circular cross-section capillary channel with a radius r:

$$f_c = \frac{\pi r^4}{8},$$

while for a rectangular cross-section channel with a width $\alpha$, height b and aspect ratio $\eta = b/\alpha$ ($\eta \geqq 1$)

$$f_R = a^4\left[\frac{\eta}{12} - \frac{16}{\pi^5}\tanh\left(\frac{\pi}{2}\eta\right)\right].$$

It is generally true that the flow rate or the volume flux is inversely proportional to the internal viscosity of fluid in the channel. Therefore, if one can control the viscosity of the fluid in the channel, one can indeed control the flow rate of the fluid passing though the channel.

The microfluidic ink feed system of the present invention has a microfluidic valve that utilizes the property of a specially formulated thermally-responsive fluid serving as the carrier fluid for transport of subject materials through a microfluidic channel such as ink feed passage 247. The viscosity of the formulated thermally-responsive fluid is sensitive to the temperature, and preferably increases with applied heat.

The "subject materials" simply refers to the materials, such as chemical or biological compounds, of interest, which may also include a variety of different compounds, including chemical compounds, mixtures of chemical compounds, e.g., a dye, a pigment, a protein, DNA, a peptide, an antibody, an antigen, a cell, an organic compound, a surfactant, an emulsion, a dispersion, a polysaccharide, colloidal particles, organic or inorganic compounds, nucleic acids, or extracts made from biological materials, such as bacteria, plains, fungi, or animal cells or tissues, naturally occurring or synthetic compositions. In the preferred embodiment of the present invention, the subject material is a printing dye or pigment The thermally-responsive material may comprise at least one kind of block copolymer with at least one block comprising poly(ethylene oxide), commonly referred to as PEO. In another form, the thermally-responsive material comprises a tri-block copolymer of poly(ethylene oxide)-poly (propylene oxide)-poly(ethylene oxide), commonly referred to as PEO-PPO-PEO dissolved in an aqueous solution. The preferred concentrations of the solutions are from about 5% to about 80%, preferably from 10% to 40% in weight.

The solutions at room temperature, e.g., 22° C., are fluidic with a typical viscosity less than 10 centipoise. The viscosity of the formulated solutions increases dramatically when raising the temperature from about 30° C. to about 80° C., as the solutions rapidly form non-fluidic gels at the elevated temperature. The viscosity change of the formulated solutions in response of temperature change is entirely reversible as the solutions turn to fluidic having the original viscosity when cooled down to its initial temperature.

In yet another form, a methyl cellulose polymer may be used as a thermally-responsive material in the carrier fluid. For example, 2.75 wt. % solution of METHOCEL® K100LV (Dow Chemical Co.) having a viscosity of about 1 poise at 50° C. and a viscosity of more than 10 poise at 75° C. can be used.

The ink used in the invention usually contains a colorant such as a pigment or dye. Suitable dyes include acid dyes, direct dyes, solvent dyes or reactive dyes listed in the COLOR INDEX but is not limited thereto. Metallized and non-metallized azo dyes may also be used as disclosed in U.S. Pat. No. 5,482,545, the disclosure of which is incorporated herein by reference. Other dyes which may be used are found in EP 802246-A1 and JP 09/202043, the disclosures of which are incorporated herein by reference.

Any of the known organic pigments can be used to prepare inkjet inks used in the invention. Pigments can be selected from those disclosed, for example, in U.S. Pat. Nos. 5,026,427; 5,085,698; 5,141,556; 5,160,370 and 5,169,436. The exact choice of pigment will depend upon the specific color reproduction and image stability requirements of the printer and application. For four-color printers, combinations of cyan, magenta, yellow and black (CMYK) pigments are used. An exemplary four color set is a cyan pigment, bis(phthalocyanyl-alumino)tetraphenyldisiloxane, quinacridone magenta (pigment red 122), pigment yellow 74 and carbon black (pigment black 7).

In addition to the thermally responsive material, a humectant may be employed in the inkjet compositions used in the invention to help prevent the ink from drying out or crusting in the orifices of the printhead. Examples of humectants which can be used include polyhydric alcohols, such as ethylene glycol, diethylene glycol(DEG), triethylene glycol, propylene glycol, tetraethylene glycol, polyethylene glycol, glycerol, 2-methyl-2,4-pentanediol, 2-ethyl-2-hydroxymethyl-1,3-propanediol(EHMP), 1,5 pentanediol, 1,2-hexanediol, 1,2,6-hexanetriol and thioglycol; lower alkyl mono- or di-ethers derived from alkylene glycols, such as ethylene glycol mono-methyl or mono-ethyl ether, diethylene glycol mono-methyl or mono-ethyl ether, propylene glycol mono-methyl or mono-ethyl ether, triethylene glycol mono-methyl or mono-ethyl ether, diethylene glycol di-methyl or di-ethyl ether, poly(ethylene glycol) monobutyl ether (PEGMBE), and diethylene glycol monobutylether (DEGMBE); nitrogen-containing compounds, such as urea, 2-pyrrolidinone, N-methyl-2-pyrrolidinone, and 1,3-dimethyl-2-imidazolidinone; and sulfur-containing compounds such as dimethyl sulfoxide and tetramethylene sulfone.

Penetrants may also be added to the inks employed in the invention to help the ink penetrate the receiving substrate, especially when the substrate is a highly sized paper. Examples of such penetrants include alcohols, such as methyl alcohol, ethyl alcohol, n-propyl alcohol, isopropyl alcohol, n-butyl alcohol, sec-butyl alcohol, t-butyl alcohol, iso-butyl alcohol, furfuryl alcohol, and tetrahydrofurfuryl alcohol; ketones or ketoalcohols such as acetone, methyl ethyl ketone and diacetone alcohol; ethers, such as tetrahydrofuran and dioxane; and esters, such as, ethyl lactate, ethylene carbonate and propylene carbonate.

Polymeric binders can also be added to the ink employed in the invention to improve the adhesion of the colorant to the support by forming a film that encapsulates the colorant upon drying. Examples of polymers that can be used include polyesters, polystyrene/acrylates, sulfonated polyesters, polyurethanes, polyimides and the like. The polymers may be present in amounts of from about 0.01 to about 15 percent by weight and more preferably from about 0.01 to about 5 percent by weight based on the total amount of components in the ink.

Surfactants may be added to the ink to adjust the surface tension to an appropriate level. The surfactants may be anionic, cationic, amphoteric or nonionic and used at levels of 0.01 to 1% of the ink composition. Preferred surfactants include Surfynol 465® (available from Air Products Corp.) and Tergitol 15-S-5® (available from Union Carbide).

A biocide may be added to the ink composition employed in the invention to suppress the growth of micro-organisms such as molds, fungi, etc. in aqueous inks. A preferred biocide for the ink composition employed in the present invention is Proxel® GXL (Zeneca Specialties Co.) at a final concentration of 0.0001–0.5 wt. %.

The pH of the aqueous ink compositions employed in the invention may be adjusted by the addition of organic or inorganic acids or bases. Useful inks may have a preferred pH of from about 2 to 10, depending upon the type of dye being used. Typical inorganic acids include hydrochloric, phosphoric and sulfuric acids. Typical organic acids include methanesulfonic, acetic and lactic acids. Typical inorganic bases include alkali metal hydroxides and carbonates. Typical organic bases include ammonia, triethanolamine and tetramethylethlenediamine.

A typical ink composition employed in the invention may comprise, for example, the following components by weight: colorant (0.05–20%), water (0–90%), a humectant (0–70%), the thermally responsive material (0.1–40%), penetrants (0–20%), surfactant (0–10%), biocide (0.05–5%) and pH control agents (0.1–10%).

Additional additives which may optionally be present in the inkjet ink compositions employed in the invention include thickeners, conductivity enhancing agents, anti-kogation agents, drying agents, waterfast agents, dye solubilizers, chelating agents, binders, light stabilizers, viscosifiers, buffering agents, anti-mold agents, anti-rusting agents, anti-curl agents, dispersants and defoamers. Examples of buffering agents include, but are not limited to sodium borate, sodium hydrogen phosphate, sodium dihydrogen phosphate, mixtures thereof and the like.

EXAMPLE 1

Viscosity vs. Temperature of Thermally-responsive Solutions

Thermally-responsive solutions were formulated by dissolving a tri-block copolymer of poly(ethylene oxide)-poly (propylene oxide)-poly(ethylene oxide), or PEO-PPO-PEO in an aqueous solution. A series of the PEO-PPO-PEO tri-block copolymers were obtained from BASF under the product trade name of Pluronic®.

A Rheometrics ARES Fluids Spectrometer, from Rheometric Scientific, Inc., equipped with a corvette geometry, was used to measure the oscillatory shear properties of the Pluronic® solutions. Dynamic viscosity was measured continuously as the temperature was ramped from 20° C. to 80° C. The typical ramp rate was 1° C. per minute. The fluids were initially characterized at 20° C. in a continuous shear experiment covering a typical range of shear rates from 1 to 100 per second. All were found to have low viscosity and Newtonian response. For the temperature scan experiments, a monitoring frequency of 10 radians per second was used.

The results are shown in the following tables:

TABLE 1

| | Viscosity (Poise) of Pluronic ® P85 Solutions | | |
|---|---|---|---|
| Temperature (° C.) | 20% | 15% | 10% |
| 25 | 0.09 | 0.037 | 0.022 |
| 30 | 0.112 | 0.033 | 0.017 |
| 35 | 0.113 | 0.031 | 0.014 |
| 40 | 0.096 | 0.026 | 0.012 |
| 45 | 0.079 | 0.022 | 0.01 |
| 50 | 0.066 | 0.019 | 0.008 |
| 55 | 0.054 | 0.016 | 0.007 |
| 60 | 0.05 | 0.014 | 0.006 |
| 62 | 0.069 | 0.016 | 0.007 |
| 64 | 0.143 | 0.029 | 0.011 |
| 66 | 0.382 | 0.065 | 0.022 |
| 68 | 1.283 | 0.185 | 0.059 |
| 70 | 5.176 | 0.792 | 0.194 |
| 72 | 15.018 | 3.684 | 0.821 |
| 74 | 31.802 | 11.303 | 3.534 |
| 76 | 46.005 | 21.505 | 9.134 |
| 78 | 52.008 | 28.574 | 13.39 |
| 80 | 51.921 | 30.369 | 17.917 |

TABLE 2

| Viscosity of 25% Pluronic ® L62 Solution | |
|---|---|
| Temperature (° C.) | Viscosity (Poise) |
| 22 | 0.072 |
| 25 | 0.068 |
| 28 | 0.069 |
| 30 | 0.073 |
| 32 | 0.081 |
| 34 | 0.1 |
| 36 | 0.136 |
| 38 | 0.237 |

TABLE 2-continued

| Viscosity of 25% Pluronic ® L62 Solution | |
|---|---|
| Temperature (° C.) | Viscosity (Poise) |
| 40 | 0.44 |
| 42 | 0.834 |
| 44 | 0.976 |
| 46 | 1.777 |
| 48 | 5.864 |
| 49 | 26.704 |
| 50 | 37.107 |
| 52 | 40.677 |
| 54 | 35.045 |
| 56 | 31.245 |

TABLE 3

| Viscosity of 22% Pluronic ® F87 Solution | |
|---|---|
| Temperature (° C.) | Viscosity (Poise) |
| 22 | 0.201 |
| 25 | 0.242 |
| 30 | 0.525 |
| 32 | 0.696 |
| 34 | 0.968 |
| 36 | 1.225 |
| 37 | 1.505 |
| 38 | 385 |
| 39 | 13873 |
| 40 | 17046 |
| 41 | 15056 |
| 42 | 14963 |
| 45 | 14512 |
| 50 | 15008 |
| 55 | 15509 |

The above results show that the Pluronic® P85 solutions with the concentrations from 10% to 20% have viscosity increases of more than 3 orders of magnitude when the temperature increases from 60° C. to 80° C., the 25% Pluronic® L62 solution has a 3 orders of magnitude viscosity increase with temperature from 30° C. to 50° C., and the 22% Pluronic® F87 solution has a more than 5 orders of magnitude viscosity increase with temperature from 30° C. to 40° C. The results demonstrated that these fluids are thermally-responsive and can be used in the device and method of the invention.

EXAMPLE 2

A Set of Thermally Responsive Inks with CMYK Colors

The thermally responsive inks were formulated by dissolving 15% wt of Pluronic® P85 in an aqueous solution. For black ink, a 5% wt dye of Food Black2 was added, for cyan ink a 6% wt dye of Avecia ProJet® Cyan Fast2 was added, for magenta ink a 5% wt dye of Tricon acid Red52 was added, and for yellow ink a 5% wt dye of acid Yellow was added. The viscosity vs. temperature measurements of thermally responsive inks were carried as described above in Example 1 and the results are shown in Table 4.

TABLE 4

Viscosity vs. temperature of the thermally responsive inks

| Temperature (° C.) | Viscosity (CentiPoise) of Thermally Responsive Inks | | | |
|---|---|---|---|---|
| | Black | Cyan | Magenta | Yellow |
| 25 | 6.9 | 5.1 | 5.1 | 6.1 |
| 60 | 3.2 | 2.0 | 2.1 | 2.8 |
| 85 | 3200 | 3100 | 41 | 30 |

The above results show that all the formulated thermally responsive inks have viscosities less than 7 centipoise from room temperature to about 60° C. and have viscosities more than 30 centipoise at 85° C. The black and cyan inks even have viscosities more than 3000 centipoise at 85° C. The results demonstrated that these inks are thermally responsive and can be used in the method of the invention.

Figure 2:
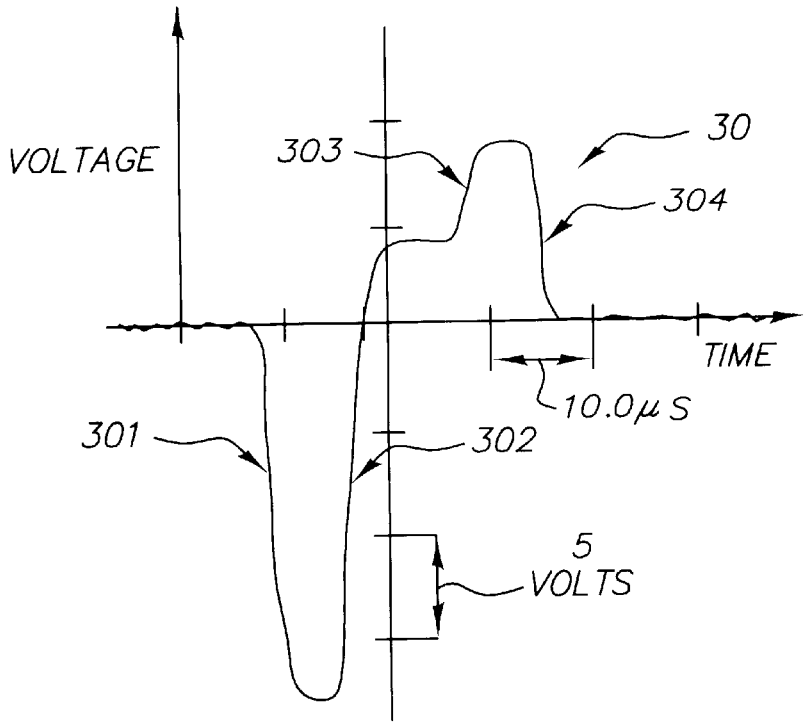
FIG. 2 is a graph of voltage versus time, illustrating the shape of an electrical drive waveform applied to an ink jet print head such as illustrated in FIG. 1.

In operation, dye or pigment in a specially formulated thermally-responsive carrier fluid is transported through ink feed passage 247 past microfluidic valve heaters 300 during the downward-going voltage edge 301, in FIG. 2, which causes an outward mechanical expansion of the actuator. Thus, ink is drawn into the interior volume of ink channel 229. Coordinated with the upward-going voltage edges 302 and 303, which cause an inward mechanical compression of the actuator to expel ink from the nozzle, heaters 300 receive electrical pulses to cause heat to be transmitted to the solution in ink feed passage 247. The viscosity of the formulated solution increases dramatically when raising the temperature from about 30° C. to about 80° C., as the solutions rapidly form non-fluidic gels at the elevated temperature. The increased viscosity quickly forms a gel, blocking ink feed passage 247. The viscosity change of the formulated solutions in response of temperature change is entirely reversible as the solutions turn to fluidic having the original viscosity when cooled down to its initial temperature. Flow resumes through passage 247 and the pressure returns to a level incapable of droplet formation.

By blocking the ink feed passage during compression of the actuator, backward flow of ink is inhibited, while allowing free forward flow into the ink chamber. During droplet ejection, the valve chokes back flow to improve efficiency. During chamber refill, the valve is opened, reducing refill time. By timing the heat pulse and the piezo device, dorp ejection efficiency and refill time can be optimized.

While different embodiments, applications and advantages of the invention have been shown and described with sufficient clarity to enable one skilled in the art to make and use the invention, it would be equally apparent to those skilled in the art that many more embodiments, applications and advantages are possible without deviating from the inventive concepts disclosed, described, and claimed herein. The invention, therefore, should only be restricted in accordance with the spirit of the claims appended hereto or their equivalents, and is not to be restricted by the specification, drawings or the description of the preferred embodiments.

The invention has been described in detail with particular reference to certain preferred embodiments thereof, but it will be understood that variations and modifications can be effected within the spirit and scope of the invention.

What is claimed is:

1. A drop-on-demand ink jet printing system for controlling delivery of inks to a receiver; said system comprising:

an ink channel having a nozzle orifice in a wall of said ink channel through which ink droplets are ejected when ink in said ink channel is subjected to a momentary positive pressure wave;

an ink feed passage opening into said ink channel and adapted to transport ink into said ink channel from an ink reservoir, wherein: said ink feed passage comprises an microfluidic channel;

a selectively-actuated valve associated with said ink feed passage and adapted to restrict the flow of ink through said ink feed passage when actuated, said selectively-actuated valve comprises a heater in thermal contact with at least a portion of the associated microfluidic channel, whereby thermally-responsive ink in said ink feed passage can selectively be heated by said heater such that the thermally-responsive ink will be caused to increase in viscosity to thereby restrict ink flow through the ink feed passage; and a controller adapted to actuate the valve in timed association with the momentary pressure wave, whereby flow of ink past the valve from the ink channel towards the reservoir is inhibited.

2. A drop-on-demand ink jet printing system as set forth in claim 1 wherein the microfluidic channel has an internal cross-sectional dimension between about 0.1 $\mu$m and about 500 $\mu$m.

3. A drop-on-demand ink jet printing system as set forth in claim 1 wherein the microfluidic channel has an internal cross-sectional dimension between about 1 $\mu$m and about 200 $\mu$m.

4. A microfluidic system for controlling delivery of thermally-responsive fluid; said system comprising:

a fluid channel having a nozzle orifice in a wall of said fluid channel through which fluid droplets are ejected when fluid in said fluid channel is subjected to a momentary positive pressure wave;

a microfluidic feed passage opening into said fluid channel and adapted to transport fluid into said fluid channel from a reservoir;

a selectively-actuated heater in thermal contact with at least a portion of the microfluidic feed passage, whereby said thermally-responsive fluid can selectively be heated to increase its viscosity to restrict the flow of fluid through said microfluidic feed passage; and a controller adapted to actuate the heater in timed association with the momentary pressure wave, whereby flow of fluid past the heater from the fluid channel towards the reservoir is inhibited.

5. A microfluidic system as set forth in claim 4 wherein the fluids comprise a material and a thermally-responsive carrier fluid.

6. A microfluidic system as set forth in claim 5 herein said thermally-responsive carrier fluid comprises a tri-block copolymer of poly(ethylene oxide)-poly(propylene oxide)-poly(ethylene oxide).

7. A microfluidic system as set forth in claim 4 wherein the microfluidic feed passage has an internal cross-sectional dimension between about 0.1 $\mu$m and about 500 $\mu$m.

8. A microfluidic system as set forth in claim 4 wherein the microfluidic feed passage has an internal cross-sectional dimension between about 1 $\mu$m and about 200 $\mu$m.

9. A microfluidic system as set forth in claim 4 wherein said thermally-responsive fluid is gelled by heat from said heater.

* * * * *